US006174137B1

(12) United States Patent
Nakamura

(10) Patent No.: US 6,174,137 B1
(45) Date of Patent: Jan. 16, 2001

(54) COMPRESSOR HAVING LOAD CONTROL

(75) Inventor: Hajime Nakamura, Takasago (JP)

(73) Assignee: Kabushiki Kaisha Kobe Seiko Sho, Kobe (JP)

( * ) Notice: Under 35 U.S.C. 154(b), the term of this patent shall be extended for 0 days.

(21) Appl. No.: 09/086,576

(22) Filed: May 29, 1998

(30) Foreign Application Priority Data

Jun. 4, 1997 (JP) ..... 9-146279

(51) Int. Cl.[7] ..... F04B 49/00
(52) U.S. Cl. ..... 417/53; 417/290; 417/298
(58) Field of Search ..... 417/290, 295, 417/298, 53

(56) References Cited

U.S. PATENT DOCUMENTS 3,961,862 * 6/1976 Edstrom et al. ..... 417/290
4,068,980 * 1/1978 Fine et al. ..... 417/295
4,135,860 1/1979 Van Nederkassel .
4,249,866 * 2/1981 Shaw et al. ..... 417/290

FOREIGN PATENT DOCUMENTS 0 482 592 4/1992 (EP) .

* cited by examiner

*Primary Examiner*—Charles G. Freay
(74) *Attorney, Agent, or Firm*—Oblon, Spivak, McClelland, Maier & Neustadt, P.C.

(57) ABSTRACT

A compressor adapted to be put into a load operating state when there exists the relation $P_d \leqq PSL$ between the discharge pressure $P_d$ and a set lower limit of pressure PSL and adapted to be put into an unload operating state when there exists the relation $P_d \geqq PSH$ between the discharge pressure $P_d$ and a set upper limit of pressure PSH, or when there exists the relation $PSL < P_d < PSH$ among the discharge pressure $P_d$, the set upper limit of pressure PSH, and the set lower limit of pressure PSL and, in addition, there exists the relation $T_c \geqq T_s$ between the count time $T_c$ indicated by a timer to be started when a preceding unload operation is started and a set time $T_s$.

7 Claims, 3 Drawing Sheets

COMPRESSOR HAVING LOAD CONTROL

BACKGROUND OF THE INVENTION

1. Field of the Invention

The present invention relates to a compressor and more particularly to a method of operating a compressor for regulating the pressure in the discharge line.

2. Description of the Related Art

Such a compressor is commonly known in which the pressure in the discharge line, i.e., the discharging pressure, is kept equal to or higher than the minimum pressure needed for the load side and also the discharging pressure is kept from becoming higher than necessary so that energy saving operation is realized by opening/closing, i.e., by turning on/off, a suction regulating valve provided in the suction line (Japanese Patent Laid-open No. 4-159491). In the compressor, such control is carried out, when the discharge pressure (=the gas pressure supplied to the load side) becomes equal to or higher than a set upper limit of pressure, that the suction regulating valve is tuned off so that the supply of the suction gas to the compressor is stopped and the compressor is put into its unload operating state, whereas when the discharge pressure becomes equal to or lower than a set lower limit of pressure, the suction regulating valve is turned on so that a maximum suction quantity is supplied, i.e., the compressor is put into its load operating state, and thus, the discharge pressure is maintained within a predetermined range.

Further, in the compressor, in view of the fact that the life spans of such parts as the electromagnetic valve are shortened and reliability thereof is deteriorated when the suction regulating valve is frequently turned on/oft such control is carried out as to restrict the period of on/off operation within a set range of time (from $\Delta t_{min}$ to $\Delta t_{max}$). Namely, the rate of change with respect to time t of the discharge pressure p ($\Delta p/\Delta t$) is detected while the compressor is driven and the set upper limit of pressure or the set lower limit of pressure is compensated for so that the aforesaid period is restricted within the set range of time. Accordingly, the larger the absolute value of the rate of change ($\Delta p/\Delta t$), the greater becomes the difference between the set upper and lower limits of pressure and, conversely speaking, the smaller the absolute value, the smaller becomes the difference between the set upper and lower limits of pressure.

There are problems with the above described conventional method of operating a compressor that it becomes necessary, when the load is changing, to compensate for the set upper and lower limits of pressure at all times and, especially when there are sudden load changes, that a period longer than an intended period must be set up to cope with such changes.

There is also such a problem with the above described operating method that an analog type pressure detector and an arithmetic unit for calculating the rate of change ($\Delta p/\Delta t$) are required.

SUMMARY OF THE INVENTION

The present invention was made to solve the above mentioned problems in the related art and it is an object of the invention to provide a compressor and a method of operating a compressor in which the discharge pressure is maintained equal to or higher than the minimum pressure needed for the load side and also an energy saving operation can be made without repeating the on/off operation frequently and using any analog type pressure detector and arithmetic unit.

In order to attain the above mentioned object, a compressor according to the invention comprises a suction regulating valve to be on-off controlled, a discharge pressure detection means, first suction regulating valve control means for bringing about a load operating state when there exists the relation $P_d \leqq PSL$ between the discharge pressure $P_d$ detected by the discharge pressure detection means and a set lower limit of pressure PSL, second suction regulating valve control means for bringing about an unload operating state when there exists the relation $P_d \geqq PSH$ between the discharge pressure $P_d$ and a set upper limit of pressure PSH, and third suction regulating valve control means for controlling, when there exists the relation $PSL<P_d<PSH$ among the discharge pressure $P_d$, the set upper limit of pressure PSH, and the set lower limit of pressure PSL, the time interval from the point of time at which an unload operation is started to the point of time at which the following unload operation is started to be not less than a set time $T_s$.

The third suction regulating valve control means may have a timer to be started when an unload operation is started and bring about an unload operating state when there exists the relation $T_c \geqq T_s$ between the count time $T_c$ indicated by the timer and the set time $T_s$.

Another compressor according to the invention comprises a suction regulating valve to be on-off controlled, a discharge pressure detection means, first suction regulating valve control means for bringing about a load operating state when there exists the relation $P_d \leqq PSL$ between the discharge pressure $P_d$ detected by the discharge pressure detection means and a set lower limit of pressure PSL, second suction regulating valve control means for bringing about an unload operating state when there exists the relation $P_d \geqq PSH$ between the discharge pressure $P_d$ and a set upper limit of pressure PSH, and third suction regulating valve control means for controlling, when there exists the relation $PSL<P_d<PSH$ among the discharge pressure $P_d$, the set upper limit of pressure PSH, and the set lower limit of pressure PSL, the load operating state so as to continue for a period not less than a set time $T_s$.

The third suction regulating valve control means may have a timer to be started when a load operation is started and bring about an unload operating state when there exists the relation $T_c \geqq T_s$ between the count time $T_c$ indicated by the timer and the set time $T_s$.

A method of operating a compressor according to the invention comprises the steps of bringing about a load operating state when there exists the relation $P_d \leqq PSL$ between the discharge pressure $P_d$ and a set lower limit of pressure PSL, bringing about an unload operating state when there exists the relation $P_d \geqq PSH$ between the discharge pressure $P_d$ and a set upper limit of pressure PSH, and starting a new unload operation when there exists the relation $PSL<P_d<PSH$ among the discharge pressure $P_d$, the set upper limit of pressure PSH, and the set lower limit of pressure PSL and, in addition, a period not less than a set time $T_s$ elapsed after the point of time at which a preceding unload operation was started.

Another method of operating a compressor according to the invention comprises the steps of bringing about a load operating state when there exists the relation $P_d \leqq PSL$ between the discharge pressure $P_d$ and a set lower limit of pressure PSL, bringing about an unload operating state when there exists the relation $P_d<PSH$ between the discharge pressure $P_d$ and a set upper limit of pressure PSH, and continuing a load operation for a period not less than a set time $T_s$ when there exists the relation $PSL<P_d<PSH$ among the discharge pressure $P_d$, the set upper limit of pressure PSH, and the set lower limit of pressure PSL.

DESCRIPTION OF THE PREFERRED EMBODIMENTS

An embodiment of the invention will be described with reference to the accompanying drawings.

Figure 1:
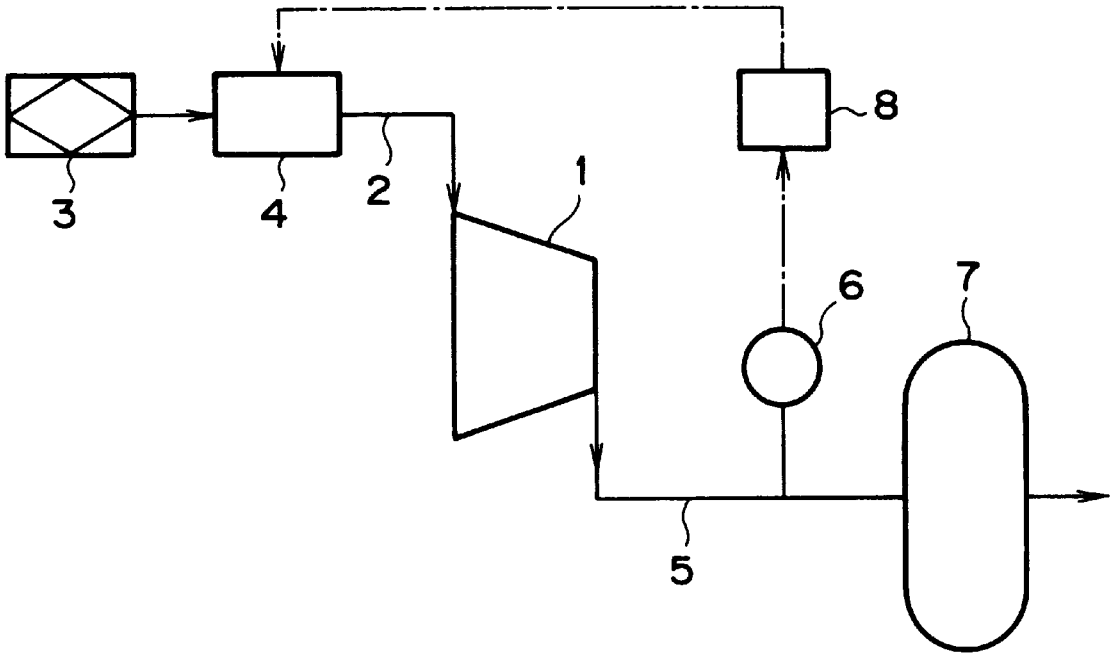
FIG. 1 is a diagram schematically showing a compressor according to the invention, to which an operating method according to the invention is applicable.

FIG. 1 is a drawing showing a compressor according to the invention to which an operating method of a compressor according to the invention is applied. In the suction line 2 of a compressor 1, such as a screw compressor, there are provided a suction filter 3 and a suction regulating valve 4, and in the discharge line 5, there are provided a pressure detector 6 capable of detecting pressure and a reservoir 7. The supply of the compressed gas to the load side is made through the reservoir 7. A pressure signal indicating the discharge pressure detected by the pressure detector 6 is input to a controller 8 and the controller 8 generates a control signal on the basis of the discharge pressure and outputs the signal to the suction regulating valve 4, whereby on/off control of the suction regulating valve 4 is carried out as described below in detail.

A first method of operating a compressor according to the invention applicable to the above mentioned compressor will be described below.

According to the operating method, when the discharge pressure $P_d$ in the discharge line 5 of the compressor 1 is equal to or lower than a predetermined, set lower limit of pressure PSL ($P_d \leqq PSL$), the suction regulating valve 4 is put into its opened state and the compressor 1 is loaded to be put into its full load operating state, whereas when the discharge pressure $P_d$ is equal to or higher than a predetermined, set upper limit of pressure PSH ($P_d \geqq PSH$), the suction regulating valve 4 is put into its closed state and the compressor 1 is unloaded and put into its no-load operating state. Further, in the case where the compressor 1, while its discharge pressure $P_d$ is maintained between the set lower limit of pressure PSL and the set upper limit of pressure PSH (i.e., $PSL<P_d<PSH$), is switched from the load operating state to the unload operating state, it is ensured that the time interval between the preceding unload operating state and the following unload operating state is not less than a predetermined, set time $T_s$.

Figure 2:
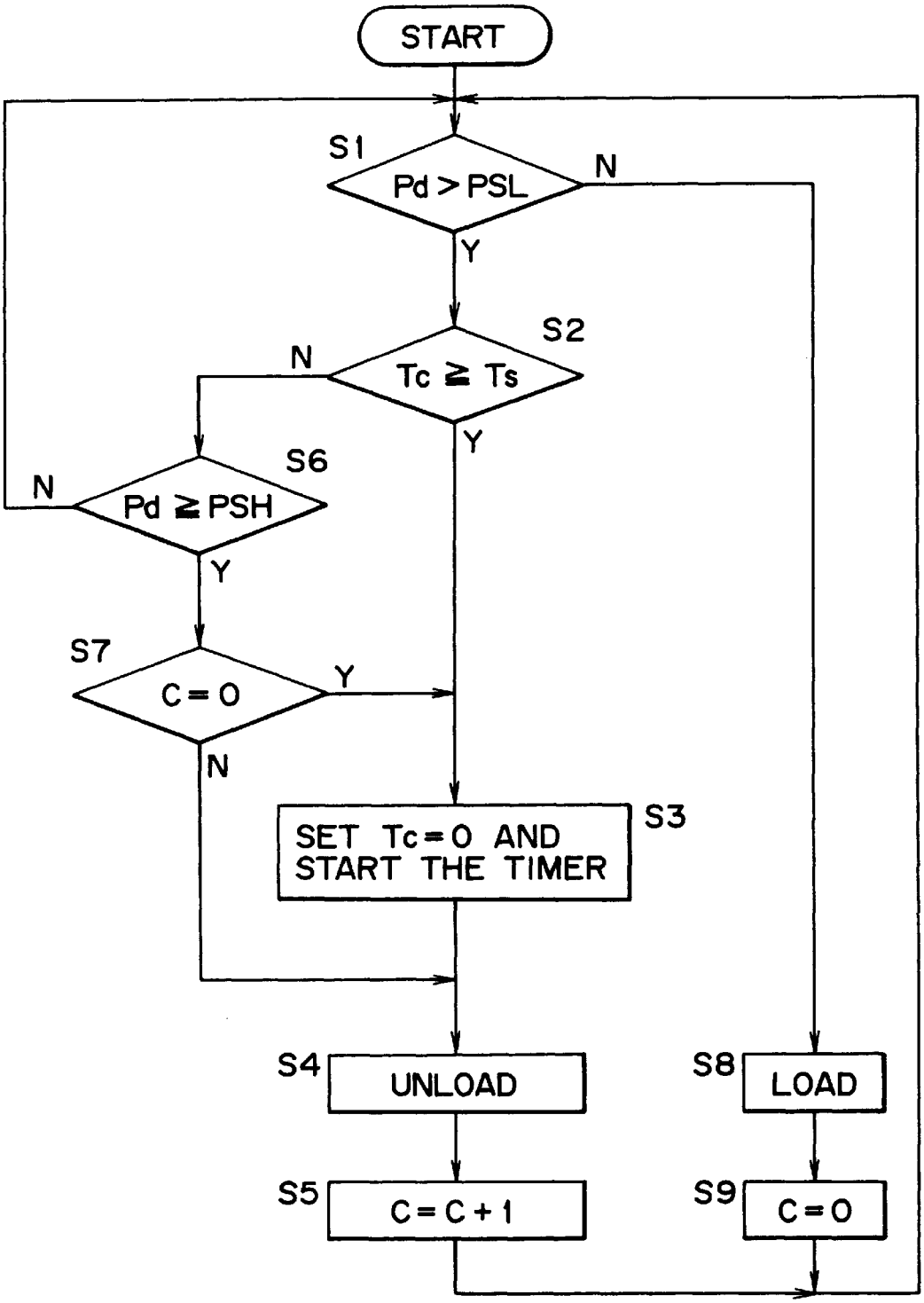
FIG. 2 is a flowchart showing a first operating method according to the invention.

The above described operating method will be described in a concrete manner with reference to FIG. 2.

At the same time as the compressor 1 is started to operate, control by means of the controller 8 is started, and first in step 1 (S1), it is decided whether or not the discharge pressure $P_d$ is higher than the set lower limit of pressure PSL (for example: 5.5 kg/cm$^2$G), and when the decision is Yes (Y) the control advances to step 2 (S2), whereas when it is No (N) the control advances to step 8 (S8). Here, the set lower limit of pressure PSL is determined taking the necessary minimum pressure decided on the load side, the pressure loss in the line from the compressor 1 to the load, and the like into consideration.

In step 2, it is decided whether or not the count time $T_c$ given by the count value of a timer incorporated in the controller 8 is equal to or greater than the set time $T_s$ (for example, 60 sec), and when the decision is Yes (Y) the control advances to step 3 (S3), whereas when it is No (N) the control advances to step 6 (S6).

In step 3, the count time $T_c$ of the timer is set at 0 ($T_c$=0), i.e., the timer is reset, and then the timer is started In step 4, an unload operation is started.

In step 5, an operating state identifying flag C is incremented with 1 (C=C+1).

The operations performed in steps 1–5 are such that the timer is restarted to count and the compressor is put into its unload operating state when the discharge pressure $P_d$ is over the set lower Eimit of pressure PSL and, in addition, at least the set time $T_s$ has elapsed since the latest unload operating state was started. Namely, unless the discharge pressure $P_d$ becomes equal to or higher than the set upper limit of pressure PSH, the time interval between the states of unload operation is controlled not to be shorter than the set time $T_s$.

On the other hand, in step 6, it is decided whether or not the discharge pressure $P_d$ is equal to or higher than the set upper limit of pressure PSH, and when the decision is Yes (Y) the control advances to step 7 (S7), whereas when it is No (N) the control returns to step 1.

In step 7, it is decided whether or not the operating state identifying flag C is 0, and when the decision is Yes (Y) the control advances to step 3, whereas when it is No (N) the control advances to step 4.

In steps 6 and 7, such operations are performed, namely, when the discharge pressure $P_d$ is over the set lower limit of pressure PSL and the discharge pressure $P_d$ is equal to or higher than the set upper limit of pressure PSH while it is possible that the set time $T_s$ has not yet elapsed since the latest unload operating state was started, the compressor is put into an unload operating state in different processing manners depending on whether the existing state is in the unload operating state or the load operating state. Here, the operating state identifying flag is so set as C=0 when the compressor is in the load operating state and the operating state identifying flag is so set as C≠0 when the compressor is in the unload operating state. Hence, when the operating state identifying flag C=0, the timer is reset and restarted upon switching of the load operating state into the unload operating state. However, when the operating state identifying flag C≠0, then since the unload operation is to be continued, nothing is done with the timer and the control advances to the step at which the compressor is put into the unload operating state.

When, in step 6, the discharge pressure $P_d$ is lower than the set upper limit of pressure PSH, then since the discharge pressure $P_d$ satisfies the condition $PSL<P_d<PSH$ and, further, the duration of the unload operating state has not yet reached the set time $T_s$, a new unload operation is not started and the control returns to step 1 so that the steps subsequent thereto are performed.

In step 8, the compressor is put into a load operating state and, in step 9 (S9), the operating state identifying flag C is set at 0 and, then, the control returns to step 1.

The step 9 is provided for indicating that the compressor is in the load operating state by means of the operating state identifying flag C and, therefore, the step 8 and the step 9 may be exchanged with each other.

As described above, the compressor is controlled to be put into a load operating state when the discharge pressure $P_d$ is equal to or lower than the set lower limit of pressure PSL, kept in its current state when the discharge pressure $P_d$ is held between the set lower limit of pressure PSL and the set upper limit of pressure PSH and, in addition, the period of the set time $T_s$ has not yet elapsed since the latest unload operating state was started, and, in other cases, put into an unload operating state. Further, it is controlled such that the time interval between a previous unload operation and the following unload operation will not become shorter than the set time $T_s$.

Now, a second method of operating a compressor according to the invention applicable to the compressor shown in FIG. 1 will be described.

According to the operating method, when the discharge pressure $P_d$ in the discharge line 5 of the compressor 1 is equal to or lower than a predetermined, set lower limit of pressure PSL ($P_d \leqq PSL$), the suction regulating valve 4 is put into its opened state and the compressor 1 is loaded and put into its full-load operating state, whereas when the discharge pressure $P_d$ is equal to or higher than a predetermined, set upper limit of pressure PSH ($P_d \geqq PSH$), the suction regulating valve 4 is put into its closed state and the compressor 1 is unloaded and put into its no-load operating state. Further, when the compressor 1 is switched from its load operating state to its unload operating state while the discharge pressure $P_d$ is held between the set lower limit of pressure PSL and the set upper limit of pressure PSH ($PSL<P_d<PSH$), it is ensured that the load operating state is continued for a period not less than a set time $T_s$.

Figure 3:
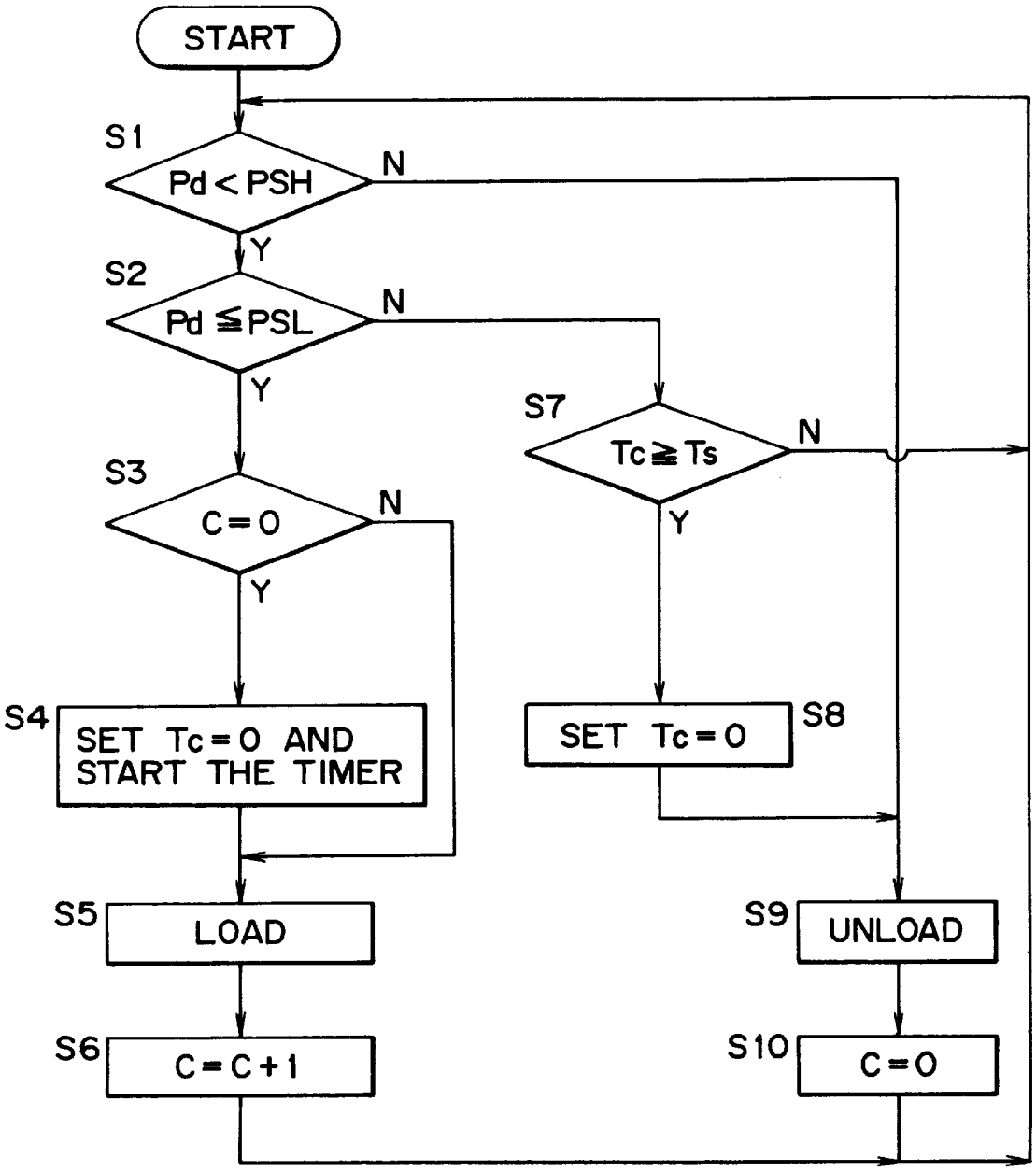
FIG. 3 is a flowchart showing a second operating method according to the invention.

The above mentioned operating method will be described in a concrete manner with reference to FIG. 3.

At the same time as the compressor 1 is started to operate, the control by means of the controller 8 is started, and first in step 1 (S1), it is decided whether or not the discharge pressure $P_d$ is lower than the set upper limit of pressure PSH, and when the decision is Yes (Y) the control advances to step 2 (S2), whereas when it is No (N) the control advances to step 9 (S9).

In step 2, it is decided whether or not the discharge pressure $P_d$ is equal to or lower than the set lower limit of pressure PSL (for example, 5.5 kg/cm$^2$G), and when the decision is Yes (Y) the control advances to step 3 (S3), whereas when it is No (N) the control advances to step 7 (S7). Here, the set lower limit of pressure PSL is determined, the same as above, taking the needed minimum pressure determined on the load side, the pressure loss in the line from the compressor 1 to the load, and the like into consideration.

In step 3, it is decided whether or not the operating state identifying flag C is 0, and when the decision is Yes (Y the control advances to step 4 (S4), whereas when it is No (N) the control advances to step 6 (S5).

In step 4, the count time $T_c$ in the timer is set at 0 ($T_c$=0), i.e., the timer is reset, and then the timer is started.

In the above steps 3 and 4, when the discharge pressure $P_d$ is equal to or lower than the set lower limit of pressure PSL and the compressor is to be put into a load operating state without condition, it is decided whether or not the compressor is already in a load operating state by judging whether the operating state identifying flag C is zero or not and, only when the compressor is not in the load operating state, i.e., it is in the unload operating state, the timer is reset and started to count.

In step 5, the compressor is put into its load operating state, and in step 6 (S6), the operating state identifying flag C is incremented with 1 (C=C+1), and, then, the control returns to step 1.

In step 7 (S7), it is decided whether or not the count time $T_c$ determined on the basis of the count value of the timer incorporated in the controller 8 is equal to or greater than the set time $T_s$ (for example, 60 sec), and when the decision is Yes (Y) the control advances to step 8 (S8), whereas when it is No (N) the control returns to step 1.

In step 8, the count value $T_c$ of the timer is set at 0 ($T_c$=0) and, then, the control advances to step 9.

In step 9, an unload operation is started.

Operations in the steps 7–9 following the step 2 are such that the timer is reset and the unload operation is started when a period equal to or longer than the set time $T_s$ has elapsed since the latest load operating state was started while the discharge pressure $P_d$ is held between the set lower limit of pressure PSL and the set upper limit of pressure PSH.

Further, when the discharge pressure $P_d$ is held between the set upper limit of pressure PSH and the set lower limit of pressure PSL and, in addition, the count time $T_c$ in the timer is shorter than the set time $T_s$, then, since the current state can be maintained, it is adapted such that the control returns to step 1 and, then, advances to the steps subsequent thereto.

In step 10 (S10), the operating state identifying flag C is set at 0 and, then, the control returns to step 1.

As described above, when the discharge pressure $P_d$ is equal to or higher than the set upper limit of pressure PSH, the compressor is put into the unload operating state without condition, whereas when the discharge pressure $P_d$ is equal to or lower than the set lower limit of pressure PSL, the compressor is put into the load operating state without condition, and when the compressor is put into the unload operating state, the operating state identifying flag C is set at C=0, whereas when the compressor is put into the load operating state, the operating state identifying flag C is kept at C≠0.

Further, when the compressor is switched from the unload operating state to the load operating state, the timer is reset and started to count, whereas when the discharge pressure $P_d$ is held under the set upper limit of pressure PSH and over the set lower limit of pressure PSL and, in addition, the load operating state has been continued for a period equal to or longer than the set time $T_s$, the compressor is switched into the unload operating state. Conversely speaking, even when the discharge pressure $P_d$ is held between the set upper limit of pressure PSH and the set lower limit of pressure PSL, the switching from the load operating state to the unload operating state is not carried out for a period not less than the set time $T_s$ after the load operation was started.

Thus, the present compressor is adapted to be put into the load operating state when the discharge pressure $P_d$ is equal to or lower than the set lower limit of pressure PSL, to be maintained in the existing state when the discharge pressure $P_d$ satisfies the condition $PSL<P_d<PSH$ and, in addition, the set time $T_s$ has not yet elapsed since the latest load operating state was started, and, in other cases, to be put into the unload operating state. And, further, it is ensured that the load operating state is continued for a period not less than the set time $T_s$.

As apparent from the foregoing description, according to the first method of the invention, it is adapted such that the compressor is put into the load operating state when there exists the condition $P_d \leqq PSL$ between the discharge pressure $P_d$ and the set lower limit of pressure PSL, whereas the compressor is put into the unload operating state when there exists the condition $P_d \geqq PSH$ between the discharge pressure $P_d$ and the set upper limit of pressure PSH or when there exists the condition $PSH>P_d>PSL$ between the discharge pressure $P_d$ and the set upper and lower limits of pressure PSH and PSL and, in addition, there exists the condition $T_c \geqq T_s$ between the count time $T_c$ indicated by the timer which is started when an unload operating state is started and the set time $T_s$.

According to the second method of the invention, it is adapted such that the compressor is put into the load operating state when there exists the condition $P_d \leqq PSL$ between the discharge pressure $P_d$ and the set lower limit of pressure PSL, whereas the compressor is put into the unload operating state when there exists the condition $P_d \geqq PSH$ between the discharge pressure $P_d$ and the set upper limit of pressure PSH or when there exists the condition $PSH>P_d>PSL$ between the discharge pressure $P_d$ and the set upper and lower limits of pressure PSH and PSL and, in addition, there exists the condition $T_c \geqq T_s$ between the count time $T_c$ indicated by the timer which is started when a load operating state is started and the set time $T_s$.

Accordingly, it has been made possible to maintain the discharge pressure higher than the minimum pressure needed for the load side and perform energy saving operation without repeating the on/off operation frequently and using any analog type pressure detector and arithmetic unit and, thereby, such effects are obtained that the prolongation of the life spans required of the parts, otherwise suffering deterioration in their durability due to the repeated operation, can be achieved.

What is claimed is:

1. A compressor comprising:

a suction regulating valve to be on-off controlled;

a discharge pressure detection means;

first suction regulating valve control means for bringing about a load operating state when there exists the relation $P_d \leqq PSL$ between the discharge pressure $P_d$ detected by said discharge pressure detection means and a set lower limit of pressure PSL;

second suction regulating valve control means for bringing about an unload operating state when there exists the relation $P_d \geqq PSH$ between the discharge pressure $P_d$ and a set upper limit of pressure PSH; and third suction regulating valve control means for controlling, when there exists the relation $PSL<P_d<PSH$ among the discharge pressure $P_d$, the set upper limit of pressure PSH, and the set lower limit of pressure PSL, the time interval from the point of time at which an unload operation is started to the point of time at which the following unload operation is started to be not less than a set time $T_s$.

2. A compressor according to claim 1, wherein said third suction regulating valve control means has a timer to be started when an unload operation is started and brings about an unload operating state when there exists the relation $T_c \geqq T_s$ between a count time $T_c$ indicated by said timer and the set time $T_s$.

3. A compressor comprising:

a suction regulating valve to be on-off controlled;

a discharge pressure detection means;

first suction regulating valve control means for bringing about a load operating state when there exists the relation $P_d \leqq PSL$ between the discharge pressure $P_d$ detected by said discharge pressure detection means and a fixed lower limit of pressure PSL;

second suction regulating valve control means for bringing about an unload operating state when there exists the relation $P_d \geqq PSH$ between the discharge pressure $P_d$ and a single fixed upper limit of pressure PSH; and third suction regulating valve control means for controlling, when there exists the relation $PSL<P_d<PSH$ among the discharge pressure $P_d$, the fixed upper limit of pressure PSH, and the set lower limit of pressure PSL, the load operating time so as to continue for a period not less than a fixed time $T_s$.

4. A compressor according to claim 2, wherein said third suction regulating valve control means has a timer to be started when a load operation is started and brings about an unload operating state when there exists the relation $T_c \geqq T_s$ between a count time $T_c$ indicated by said timer and the set time $T_s$.

5. A method of operating a compressor comprising the steps of:

bringing about a load operating state when there exists the relation $P_d \leqq PSL$ between the discharge pressure $P_d$ and a set lower limit of pressure PSL;

bringing about an unload operating state when there exists the relation $P_d \geqq PSH$ between the discharge pressure $P_d$ and a fixed upper limit of pressure PSH; and starting a new unload operation when there exists the relation $PSL<P_d<PSH$ among the discharge pressure $P_d$, the set upper limit of pressure PSH, and the set lower limit of pressure PSL and, in addition, a period not less than a set time $T_s$ has elapsed since the point of time at which a preceding unload operation was started.

6. A method of operating a compressor comprising the steps of:

bringing about a load operating state when there exists the relation $P_d \leqq PSL$ between the discharge pressure $P_d$ and a fixed lower limit of pressure PSL;

bringing about an unload operating state when there exists the relation $P_d \geqq PSH$ between the discharge pressure $P_d$ and a fixed upper limit of pressure PSH; and continuing a load operation for a period not less than a set time $T_s$ when there exists the relation $PSL<P_d<PSH$ among the discharge pressure $P_d$, the fixed upper limit of pressure PSH, and the fixed lower limit of pressure PSL.

7. A compressor comprising:

a suction regulating valve to be on-off controlled;

a discharge pressure detection means;

first suction regulating valve control means for bringing about a load operating state when there exists the relation $P_d \leqq PSL$ between the discharge pressure $P_d$ detected by said discharge pressure detection means and a fixed lower limit of pressure PSL;

second suction regulating valve control means for bringing about an unload operating state when there exists the relation $P_d \geqq PSH$ between the discharge pressure $P_d$ and a fixed upper limit of pressure PSH; and third suction regulating valve control means for controlling, where there exists the relation $PSL<P_d<PSH$ among the discharge pressure $P_d$ the set upper limit of pressure PSH, and the set lower limit of pressure PSL, the load operating time so as to continue for a period not less than a set time $T_s$ independent of said fixed upper limit.

* * * * *